US006173733B1

(12) United States Patent
Pruitt et al.

(10) Patent No.: US 6,173,733 B1
(45) Date of Patent: Jan. 16, 2001

(54) ENCLOSURE FOR COMPACT DESIGN BACKFLOW PREVENTION DEVICE

(75) Inventors: Charles Gerald Pruitt, Nashville; Earl Guy Greco, Ashland City, both of TN (US)

(73) Assignee: Hydrocowl, Inc., Nashville, TN (US)

( * ) Notice: Under 35 U.S.C. 154(b), the term of this patent shall be extended for 0 days.

(21) Appl. No.: 08/984,678

(22) Filed: Dec. 3, 1997

(Under 37 CFR 1.47)

(51) Int. Cl.[7] ..... E03B 1/00

(52) U.S. Cl. ..... 137/382; 137/377; 52/21; 52/22

(58) Field of Search ..... 137/377, 382; 52/21, 22

(56) References Cited

U.S. PATENT DOCUMENTS 4,556,080 * 12/1985 Picaud ..... 137/377
4,890,638 * 1/1990 Davenport ..... 137/377

OTHER PUBLICATIONS

Exh. 1—1–pg product brochure for Dyer Standard D–100, 1996.
Exh. 2—2–pg. product brochure for Strong Box aluminum insulated backflow enclosure, Strong Box, inc., Ontario, CA, 1996.
Exh. 3—4–pg. product brochure for Windbreaker backflow Prevention device covers & pumphouses, SMI, Laurel Hill, FL, 1996.
Exh. 4—2–pg. product brochure for Hot Box "Designer Series" enclosure with 2–pg. Hot Box newsletter discussing introduction of product. Applicant submits this information in the interest of complete disclosure because it predates Applicant's filing date, but Applicant does not admit that this information constitutes prior art. Applicant can swear behind if necessary, 1996.
2–page brochure for Lok Box™ protective enclosures, Hot Box®, Jacksonville, Florida, 1996.
4–page brochure for JustSet Thermo Shelters, Pennsylvania Insert Corporation, Spring City, PA, 1996.
4–page brochure for Water Safe™ by G&C Enclosures, Inc., Mt. Juliet, TN, 1996.

* cited by examiner

*Primary Examiner*—A. Michael Chambers
(74) *Attorney, Agent, or Firm*—Luedeka, Neely & Graham, P.C.

(57) ABSTRACT

An enclosure for a fluid flow control device of the type comprising a first valve positioned substantially vertically in a fluid flow pipe and a second valve positioned horizontally in a fluid flow pipe to form a compact backflow prevention device configuration. The enclosure comprises a front wall panel, a back wall panel, at least one removable side access panel and a top panel hingedly attached to the front wall and the back wall to open from a side of the enclosure for enabling unrestricted access to the components of the fluid flow control device contained therein. The enclosure includes at least one lift support device operably attached to the top panel and one of the wall panels to retain the top in an upright position when the top is opened to enable full access to the fluid flow control device. Locking devices are provided to prevent unauthorized access to the enclosure through the top panel and the at least one side access panel.

17 Claims, 8 Drawing Sheets

ENCLOSURE FOR COMPACT DESIGN BACKFLOW PREVENTION DEVICE

BACKGROUND OF THE INVENTION

The present invention relates generally to protective enclosures for fluid flow devices and fluid flow control devices (hereinafter collectively referred to as "fluid flow devices"), and more particularly to protective enclosures having a plurality of insulated modular panels and a hinged roof.

A fluid flow device, such as a valve, pump, or backflow prevention device, typically includes a metering or control mechanism to regulate the fluid flow within, into or out of a piping system. In the case of a backflow prevention device, one or more check valves are incorporated into a fluid flow line to prevent the backflow of any liquid and contaminated matter into the main fluid line. Many of the aforementioned fluid control devices are installed outdoors, either above ground or above the freeze line of the ground. Therefore, in certain geographical areas it is important to enclose such devices to protect them from hostile weather conditions, particularly freezing temperatures.

Fluid flow devices often require maintenance and/or testing to insure that the device is operating properly. Thus, in addition to providing protection from the elements, enclosures for fluid flow devices must also be configured to enable easy access to the fluid flow device contained therein.

There have been several attempts to devise enclosures which protect fluid flow devices from freezing temperatures and which also provide access to the device for testing and maintenance purposes.

One such attempt was disclosed in U.S. Pat. No. 4,890,638, issued to Davenport and incorporated by reference as if fully set forth herein. The Davenport patent discloses a protective enclosure for a backflow prevention device including a rectangular cover member having insulation top and side walls secured to a platform member. One of the side walls is provided with a drain opening adjacent the platform member. The side walls may be sub-divided into removable side panels to facilitate access to the interior space of the cover member. U.S. Pat. No. 4,726,394 and U.S. Pat. No. Reissue 33,523, issued to Devine and incorporated by reference as if fully set forth herein, are both directed to a heated cover for pipeline backflow preventer component assembly. The Devine patents disclose a heated, insulated cover for a portion of a pipeline with valve and backflow preventer components. The cover is sectionalized into several side sections and top wall segments adapted to be joined along longitudinal and transverse lines and clamped together. The cover further includes a drain opening and doors to permit access to the interior of the cover.

A conventional BFP device includes a pair of check valves, a relief valve and shut-off valves positioned in a straight run of pipe. The length flange-to-flange of a traditional BFP for larger diameters is excessive. When elbows are added the flange-to-flange length may increase as much as fifty percent, thus requiring that the enclosure be even longer. These large above-ground assemblies and enclosures are expensive to install and may create undesirable obstructions, particularly when located near a street.

The trend in the manufacture of BFP devices is toward smaller, compact designs. For example, many BFP devices now comprise a vertical or "N-shaped" configuration in which one of the check valve covers is removable from the top of the valve assembly, and the other check valve cover is removable from the side of the valve assembly. The devices disclosed in the above-mentioned patents are designed to accommodate BFP devices having a conventional inline configuration. Accordingly, the enclosures provide removable side access panels or doors to facilitate maintenance of the valve assemblies, but they do not provide any means of access from the top.

One style of enclosure, manufactured by Hot Box, Jacksonville, Fla., and sold under the trade designation Hot Box®, comprises a generally square or rectangular structure having a front wall, a back wall, spaced apart side walls and a hinged roof portion. The roof portion further includes a top, a front and spaced apart triangular sides. Accordingly, the roof may be opened to enable partial front and top access to the BFP device.

Another enclosure, manufactured by Pennsylvania Insert Corporation, Spring City, Pa., and sold under the trade designation Just Set™ Thermo Shelters, is similarly configured. The Thermo Shelter comprises two triangularly shaped sections hinged to form a generally square or rectangular structure. The roof portion may be opened to enable front and top access to the BFP device.

The configuration and location of the access means of these enclosures are incompatible with the configuration of many of the compact BFP devices now in use. Neither of these enclosures enables full side access to the valve assembly, which is preferred for the compact BFP configuration described hereinabove.

For example, the walls that comprise the bottom portion of the Hot Box® enclosure limit a repair person's ability to observe the check valve of the BFP, restrict the repair person's access to the check valve and impair the repair person's ability to easily remove the components of the valve body. Another drawback associated with the Hot Box® device is that the bottom portion of the enclosure extends above the level of test cocks that are located just above the bottom flange of the BFP, thus preventing full access for testing purposes. Furthermore, the configuration of the Hot Box® enclosure restricts the degree of rotation of a valve wrench, should one be required to operate the hand wheel of the gate valves of the BFP device.

Another enclosure, manufactured by G&C Enclosures, Inc. and marketed under the trade name Water Safe, comprises a plurality of walls, including access panels, and a top attached to the walls. The top comprises two panels hingedly attached such that one panel may be pivoted open to overlie the adjacent panel. However, this configuration restricts access through the top of the enclosure to one-half of the enclosure area, thus limiting the accessibility of the entire BFP device.

Thus, while enclosures for fluid flow control devices provide some means of access to the device contained therein, the configurations described hereinabove are known to be limited in their usefulness when used with certain valve assemblies. Accordingly, it would be advantageous to invent an insulated cover or enclosure assembly that is configured to accommodate and to enable full access to all of the components of compact BFP devices.

SUMMARY OF THE INVENTION

The present invention is directed to an apparatus for covering a fluid flow control device. The invention comprises a front wall panel, a back wall panel, a hinged top or roof panel, and a pair of removable access panels interconnected with the front and back walls. The front and back walls and the interconnected access panels are positioned on a ground surface, which preferably comprises a concrete pad or base. Interior anchoring brackets are provided to anchor the end walls to the ground surface.

The spaced apart ends of each of the front and back wall panels are preferably turned in perpendicularly to form legs. Accordingly, when the enclosure is assembled, the legs project inwardly from the front and back wall panels to form a portion of the side walls. The access panels include vertical flanges projecting laterally from spaced apart sides, and which overlap the legs of the front and back wall panels when the access panels are installed in the enclosure.

Each of the panels comprises an outer skin covering insulating material, and may further include at least one frame member.

The roof is hingedly attached to the legs of the front and back wall panels and, thus, opens from the side of the enclosure in order to provide unrestricted access to the fluid flow device contained therein. Lift supports attached to the roof and wall panels are provided to retain the roof in an upright position when the roof is lifted. A locking mechanism is also provided to secure the roof in a closed position.

The compact enclosure of the present invention is configured to enable access to the check valve covers of the BFP device through the access panel openings. Thus, when the access panels are removed, the check valve covers are immediately accessible. The cover bolts and the internal components of the check valve may be easily removed. The location of the access panels or doors enables a repair person to visually observe the inside of the check valve to facilitate disconnection of the internal parts thereof. Further, the access openings of the enclosure extend to the ground surface to enable easy access to the lower components of the BFP device and to provide full access to test cocks that are located just above the bottom flange of the BFP device.

Enclosures with fixed roofs must be sized to provide sufficient vertical height to enable removal of internal check valve components. The hinged roof of the enclosure of the present invention enables a repair person to visually observe the inside one of the check valves of the BFP device and to easily access the valve for installation, repair or disconnection purposes.

Further, the hand wheels for the gate valves of the BFP device, whether non-rising stem (NRS) or outside stem and yoke (OS&Y), are directly accessible through the access panel openings of the enclosure. Thus, in the event that a repair person must use a valve wrench to operate the hand wheel, the fully open access panel enables the maximum range of motion with respect to operation of the valve wrench.

It is an object of the present invention to provide an insulated enclosure configured to cover and provide unrestricted access to a fluid flow control device comprising a first check valve positioned substantially vertically in a fluid flow pipe and a second check valve positioned horizontally in a fluid flow pipe.

It is another object of the present invention to provide an enclosure for a fluid flow control device comprising opposing front and back wall panels, at least one removable side access panel, and a hinged roof panel that is configured to open from a side of the enclosure.

It is yet another object of the present invention to provide an enclosure for a fluid flow control device comprising front and back wall panels, each having spaced apart ends turned in perpendicularly to form legs.

It is another object of the present invention to provide an enclosure for a fluid flow control device comprising a front wall panel, a back wall panel, at least one side access panel, and a hinged roof having at least one lift support for retaining the roof panel in an upright position when the roof is opened.

These and other objects, features and advantages shall become apparent after consideration of the description and drawings set forth herein. All such objects, features and advantages are contemplated to be within the scope of the present invention even though not specifically set forth herein.

DESCRIPTION OF THE PREFERRED EMBODIMENT

Figure 1:
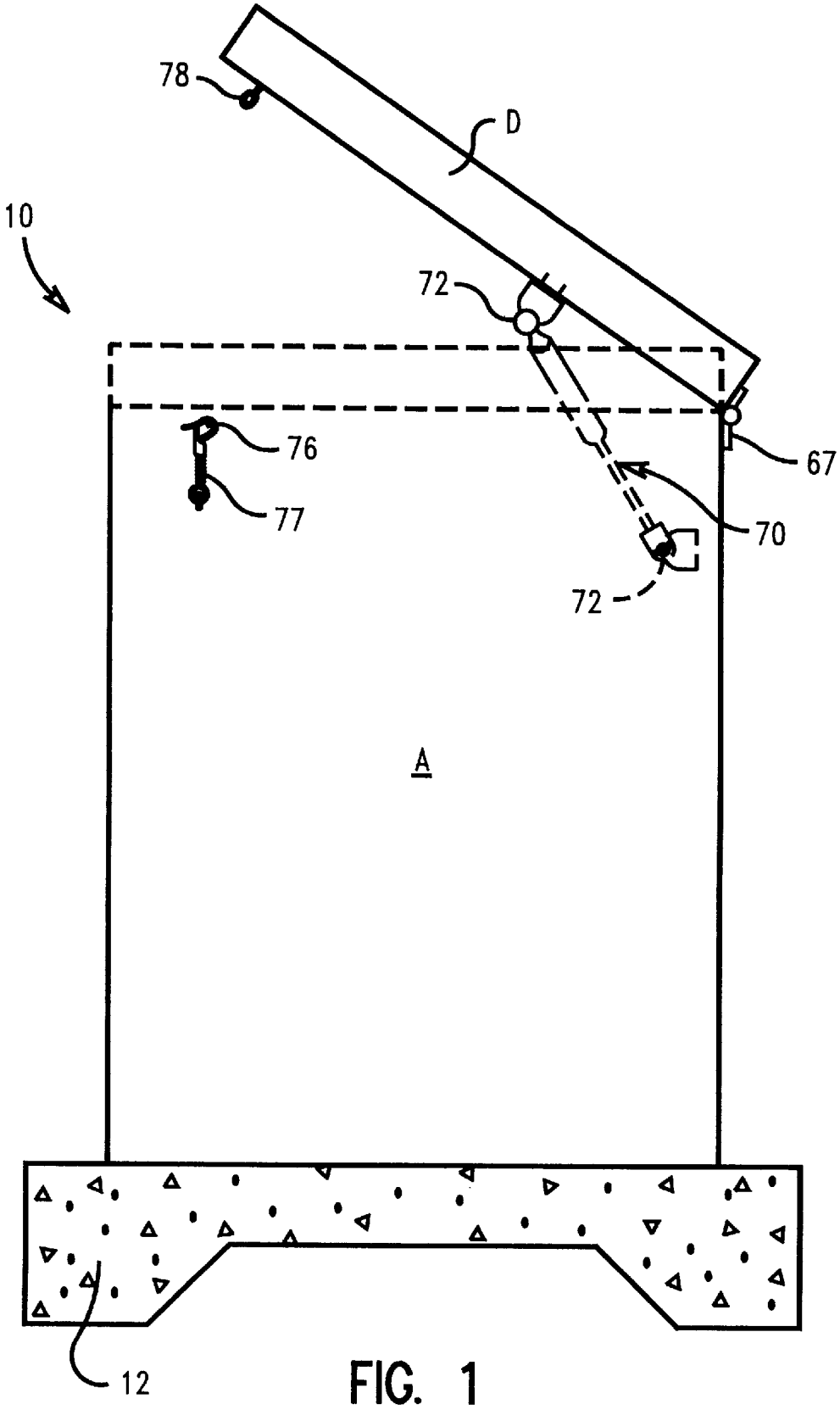
FIG. 1 is side view of an embodiment of the enclosure of the present invention.

An embodiment of the present invention is designated generally by the reference numeral 10 in FIG. 1. The enclosure 10 rests on a support surface 12, which may comprise a ground surface or a pad, and covers a fluid flow control device 14 contained within an interior space 16 (see FIGS. 3 and 4).

A typical fluid flow control device 14 includes a backflow prevention device (hereinafter "BFP") comprising a pair of check valves 18 and 20, a relief valve 22, and a pair of cut-off valves 24 and 26 positioned in a fluid flow pipe between and inlet pipe 28 and an outlet pipe 30.

Figure 2:
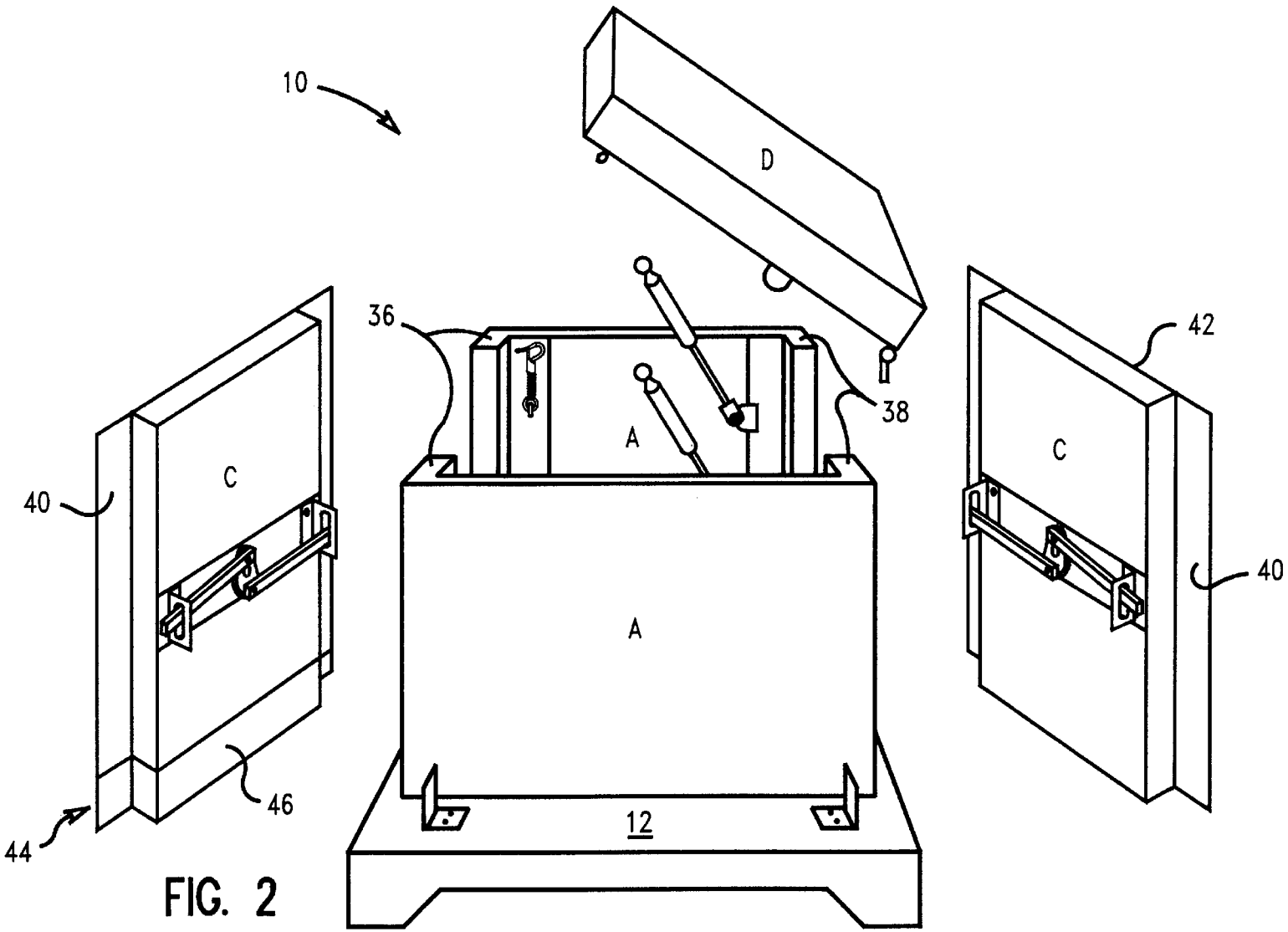
FIG. 2 is an exploded perspective view of the embodiment of the present invention shown in FIG. 1.

With reference to FIG. 2, the preferred embodiment of the enclosure 10 of the present invention comprises a plurality of insulated panels including opposing front and back walls A, a roof or top panel D, and interconnecting side panels C. The side panels C preferably include at least one removable access panel C (two are shown). Anchoring brackets 32 are attached to the wall panels A and the support surface 12 with fasteners 34, such as screws or bolts, to secure the enclosure 10 to the support surface 12 (see FIG. 2B). The anchoring brackets 32 are preferably secured to the support surface 12 with expansion anchors, and to the wall panels A with screws.

In the preferred embodiment, each of the wall panels A includes spaced apart end portions that are turned in perpendicularly to form legs 36 and 38. In this manner, each wall panel A is substantially U-shaped in top view.

Access panel C includes spaced apart sides, each having a flange 40 projecting laterally from vertical edges of an outer surface 42 of the panel C. Accordingly, when access panel C is installed in enclosure 10, flanges 40 are positioned in overlapping flush engagement with corresponding outer vertical edge surfaces of the legs 36 and 38 of wall panels A. In the preferred embodiment, one of the access panels C is provided with a transverse drain opening in a bottom end portion for enabling water to exit from the interior 16 of the enclosure 10. The drain opening is preferably covered by a hinged door 46 that pivots outwardly from the interior 16 of the enclosure 10.

Figure 3:
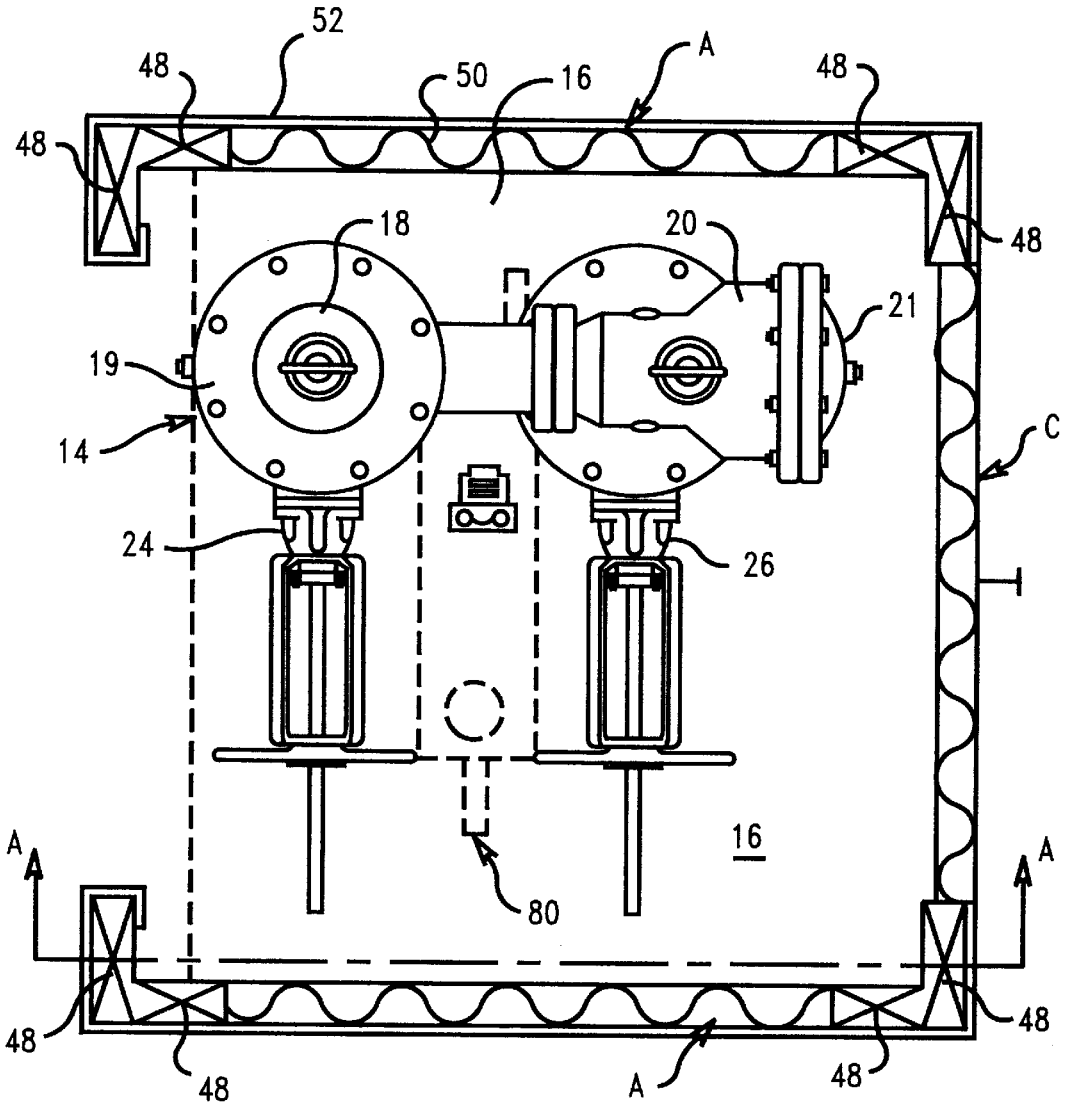
FIG. 3 is a top view of the enclosure of the present invention showing a backflow prevention device enclosed therein and illustrating the relationship between the outer panel skin, the insulation and the support member(s)
Figure 4:
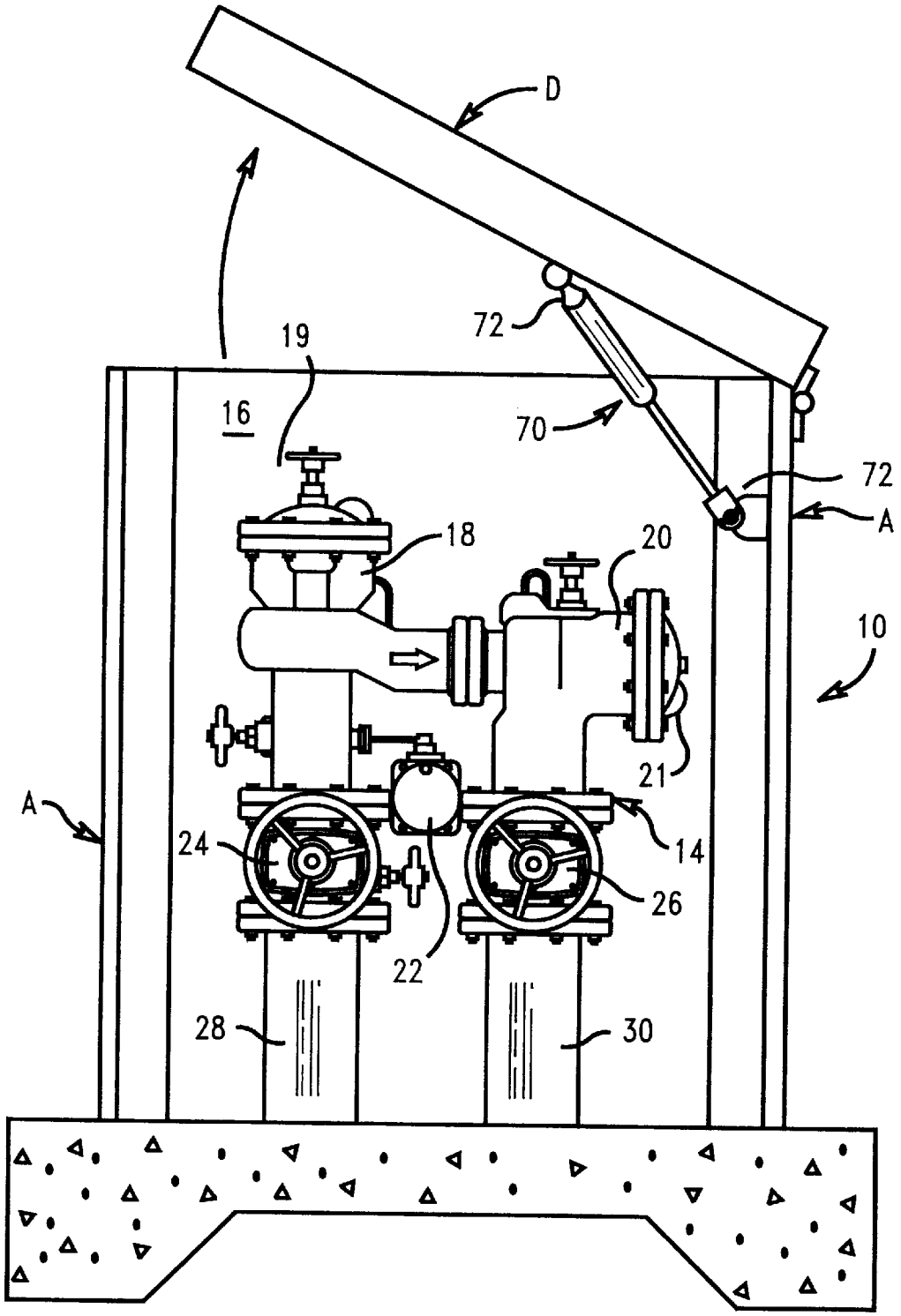
FIG. 4 is a front sectional view of the enclosure of the present invention taken along lines A—A of FIG. 3.

With reference to FIG. 3, the construction of a typical wall panel A and the profile of access panels C are shown. Each panel A typically includes at least one frame member 48 and insulating material 50 covered by an outer skin 52. The legs 36 and 38 of wall panel A each comprise an upright frame member 48 extending perpendicularly from one of the upright frame members 48 at the spaced apart ends of the wall panel A. The frame member 48 may be constructed of wood, metal or any other suitable rigid material. Further the frame members 48 at the ends of the wall panels A and the frame members 48 that form the legs 36 and 38, may be formed from a single L-shaped member. The outer skin 52 may fold over and slightly overlap the peripheral edges of the at least one frame member 48 and the insulating material 50 if desired to retain the frame member 48 and the insulating material 50 in position.

The frame member 48 is preferably constructed of hardwood, such as redwood or cedar, but it may also be constructed of any other suitable material, such as plastic, metal, composites, synthetics and the like. The outer skin 52 is preferably constructed of metal, such as stainless steel, but it may also be constructed of any other suitable material, such as fiberglass, plastic, composites and the like.

The access panels C and roof panel D are of substantially the same construction as the side panels A. Accordingly, panels C and roof D include insulating material 50 covered by a metal cladding or skin 52, and may further include at least one frame member 48.

Figure 6:
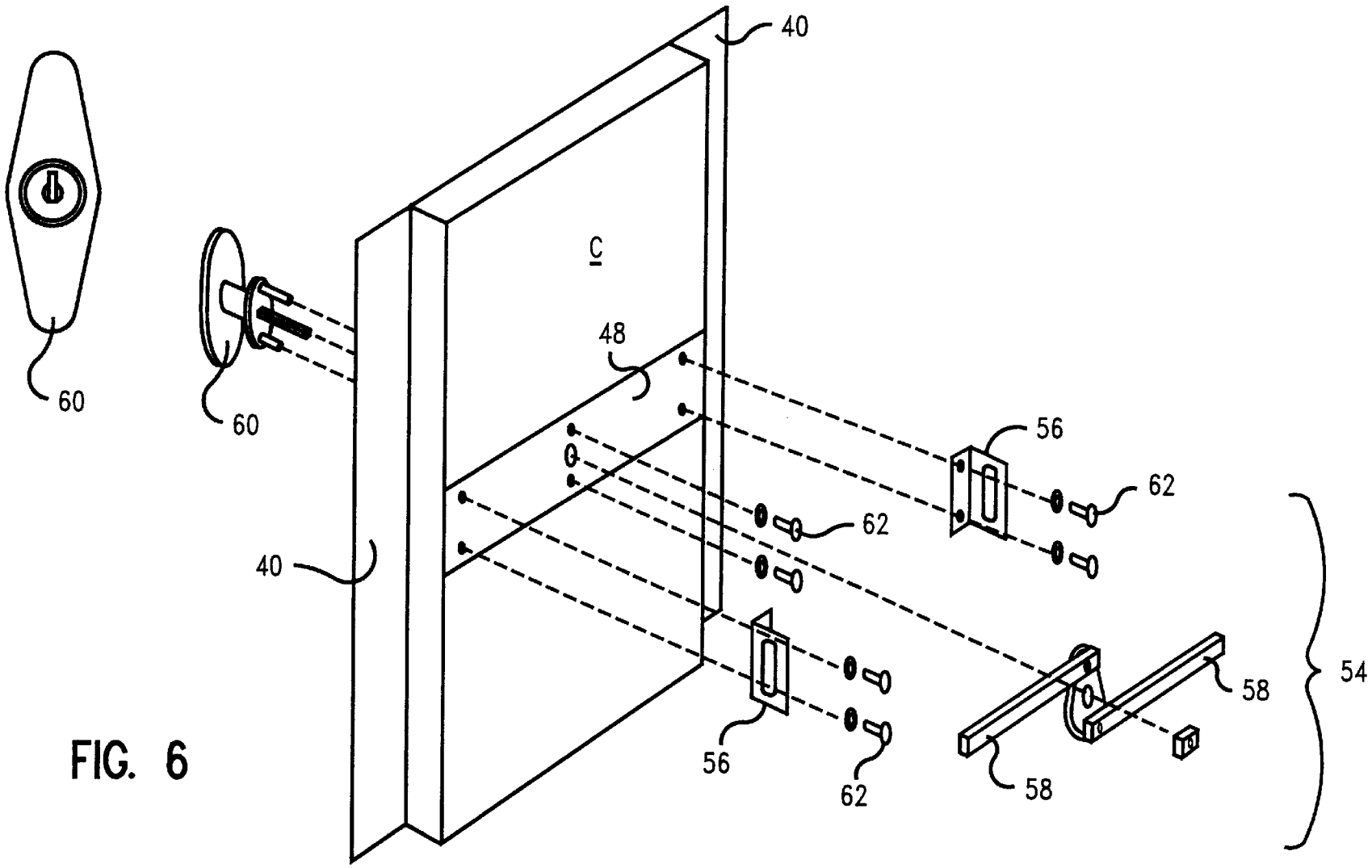
FIG. 6 is an exploded perspective view of an embodiment of the removable access panel of the present invention showing the locking mechanism.

With reference to FIG. 6, the removable access panel C includes a locking mechanism 54 comprising pair of spaced apart bar guide brackets 56, locking bars 58, handle 60 and fasteners 62 for mounting the brackets 56 to an interior surface of the panel C. The locking mechanism 54 is preferably mounted to a transverse frame member 48 for added structural integrity.

Figure 5:
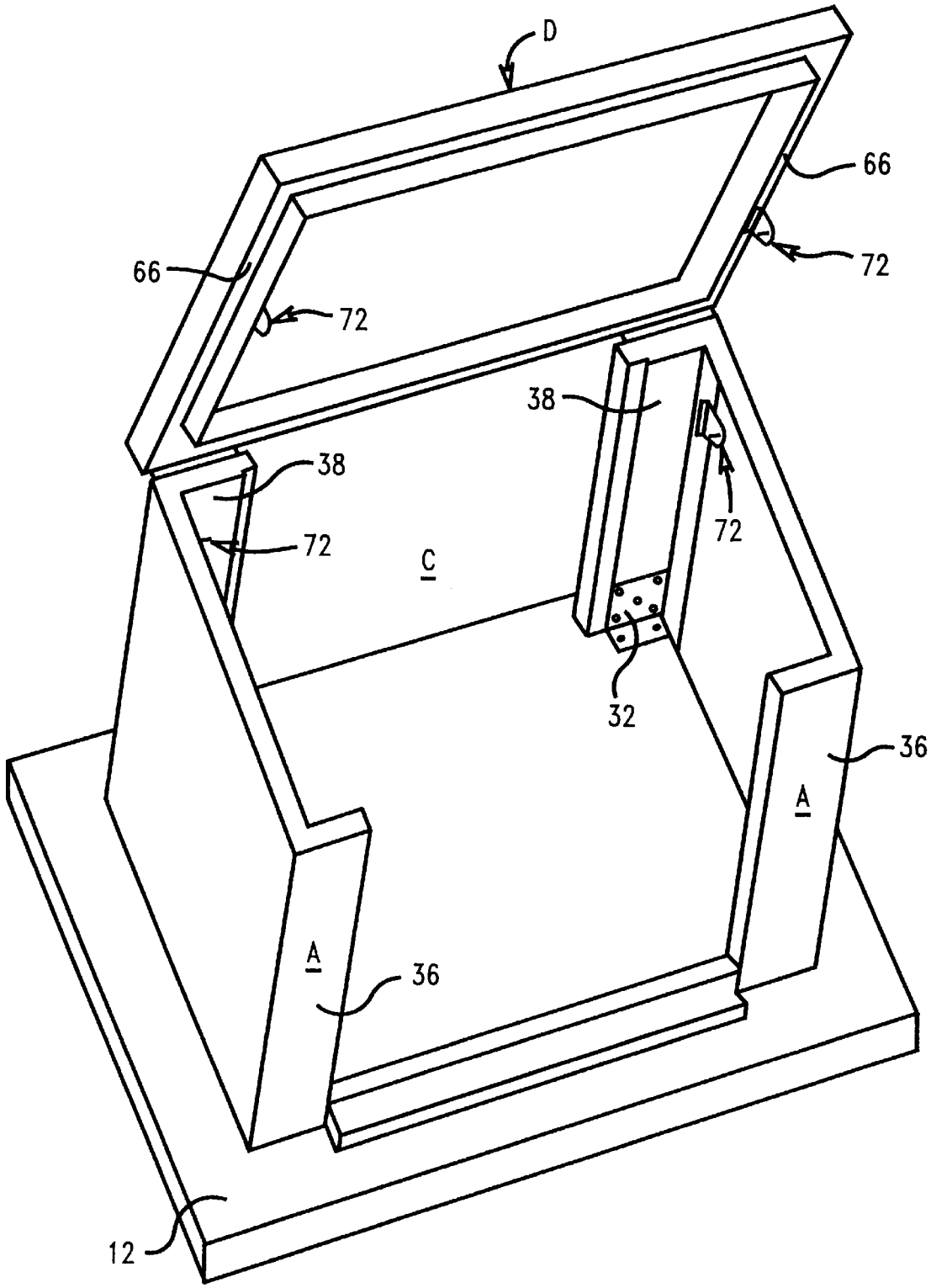
FIG. 5 is a side perspective view of the enclosure of the present invention showing the use of the AMG to align the wall panels.

An alignment guide designated generally by the reference letter "AMG" is illustrated in FIG. 5. The alignment guide AMG is used to facilitate the proper alignment of the wall panels A on the support surface 12. In this manner, the alignment guide AMG is temporarily positioned between the wall panels A to achieve proper spacing therebetween.

The top or roof panel D is hingedly attached along a side edge to the front and back wall panels A such that the top D opens from the side of the enclosure 10. A lip 66 formed around the perimeter of the roof panel D provides a surface for engaging top edge surfaces of the wall panels A and the access panels C when the top D is in a closed position (see FIG. 5). The roof panel D is operably attached to the wall panels A by at least one hinge 67 (see FIG. 2A). In the preferred embodiment, a flange 69 extends downwardly from an outer edge 64 of one side of the roof panel D to enable the roof panel D to be hingedly attached to the front and back wall panels A as shown in FIG. 2C.

Figures 2A, 2B, 2C, 2D:
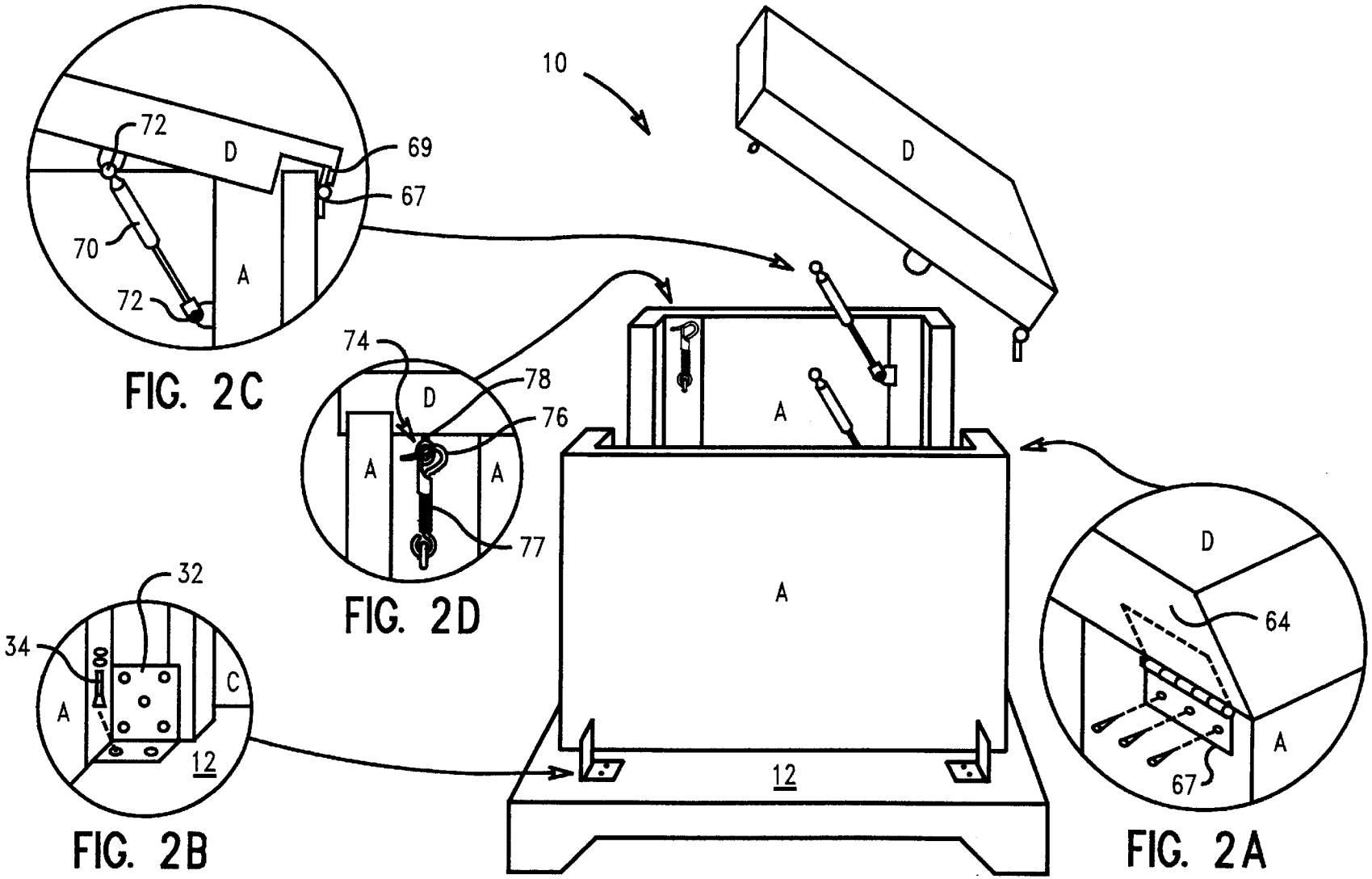
FIG. 2A is a partial perspective view of the enclosure of the present invention showing the hinged attachment of the roof to the wall.
FIG. 2B is a partial perspective view of the enclosure of the present invention showing the anchoring bracket for securing the enclosure to a ground surface.
FIG. 2C is a partial perspective view of the enclosure of the present invention showing the lift support mechanism.
FIG. 2D is a partial perspective view of the enclosure of the present invention showing the locking mechanism for securing the roof in a closed position.

The enclosure 10 further includes at least one lift support 70 for retaining the top or roof D in an upright position when the top or roof D is opened (see FIGS. 1 and 2C). The lift support(s) 70 are designed to lift and support substantially all of the weight of the roof to eliminate the need for independent support by repair personnel or other support means. In the preferred embodiment, the lift support 70 comprises a gas-filled cylinder and piston. However, other suitable lift support devices, such as a hydraulic cylinder and piston device, may be used. The lift support 70 is preferably attached to the top or roof D and the wall panels A by a ball and socket type bracket 72; however, other suitable attachment brackets are contemplated to be within the scope of the present invention.

The side opening feature of the enclosure 10 facilitates unrestricted access to a BFP device having a substantially vertical or "N-shaped" configuration. This configuration typically includes a first check valve 18, which is positioned substantially vertically in the fluid flow pipe, and a second check valve 20, which is positioned substantially horizontally in the fluid flow pipe (see FIGS. 3 and 4). In order to access the valve body of the vertically positioned valve 18, the cover 19 must be removed from the top of the valve assembly. In order to access the horizontally positioned valve 20, the cover 21 must be removed from the side of the valve assembly.

The enclosure 10 of the present invention is configured such that substantially all of the check valve bolted flange of each of the first and second check valves 18 and 20 is directly accessible through the access openings. Accordingly, the top or roof D opens away from the vertically positioned check valve 18, and access panels C form removable sides of the enclosure 10. Thus, maintenance personnel have unrestricted access to the vertically positioned valve 18 via the top D and one of the side access panels C, and to the horizontally-positioned valve 20 via the other side access panel C, and can easily access the internal components of the first and second check valves 18 and 20.

With reference to FIGS. 1 and 2D, the roof D further includes a locking device 74 for securing the enclosure 10 and for preventing unauthorized entry. In the preferred embodiment, the locking device 74 comprises a hook 76 having a spring-loaded connector 77, and an eyelet 78 connected to the top or roof panel D. The connector 77 locks the hook 76 in place about a circular eyelet 78.

Figure 7:
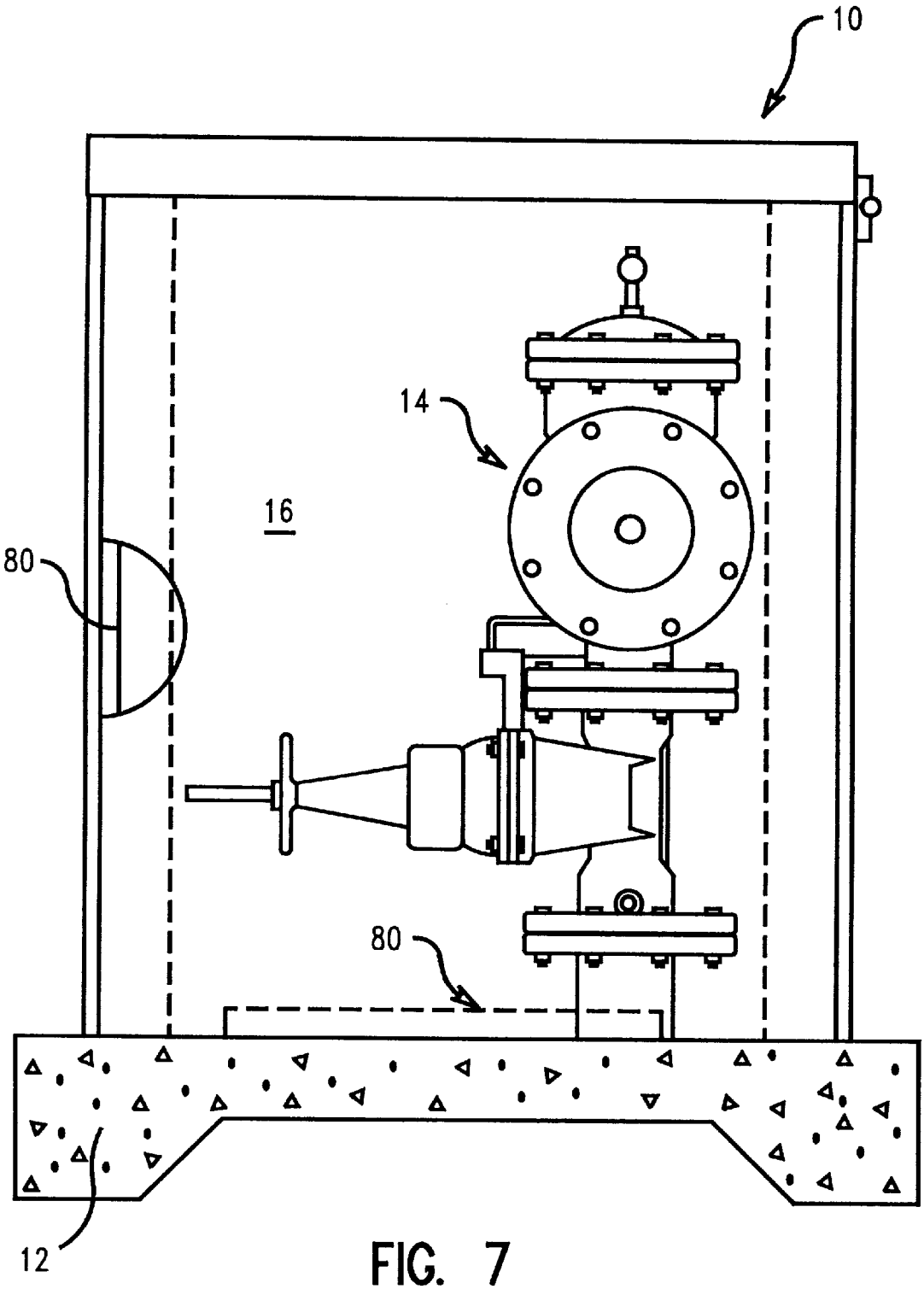
FIG. 7 is a side sectional view of the enclosure of the present invention showing alternative locations for a heater.
Figure 3:
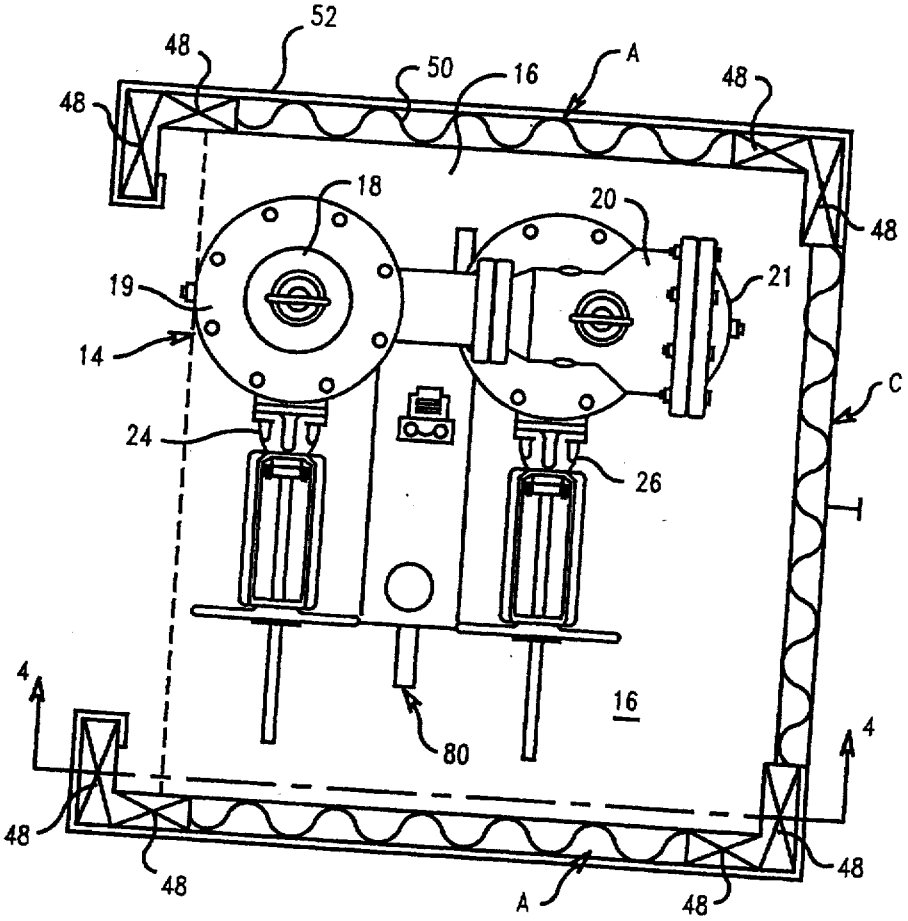
Figure 7:
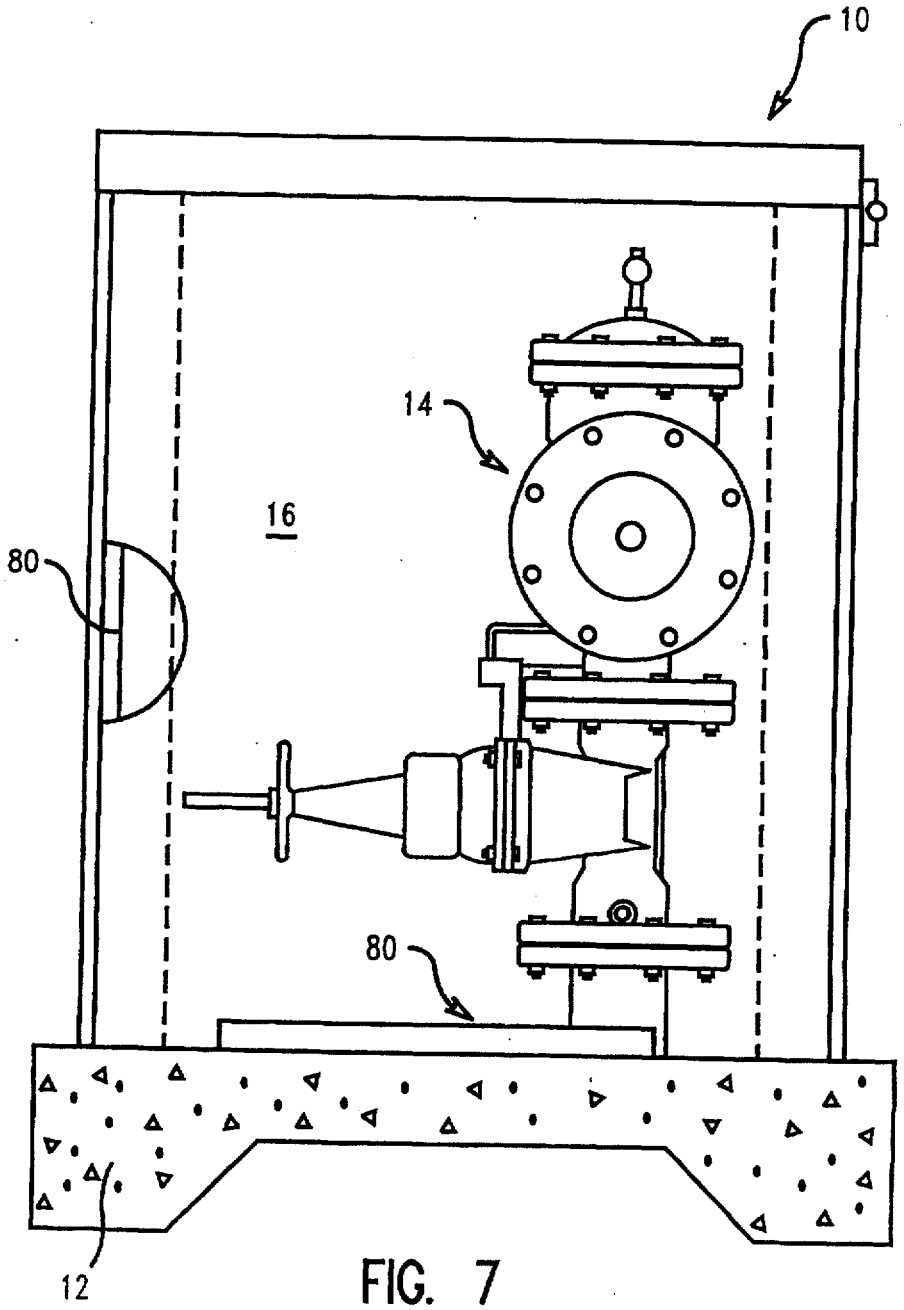

A heater 80 may be positioned within the enclosure 10 to prevent the BFP device from freezing (see FIG. 7).

Thus, although there have been described particular embodiments of the present invention of a new and useful enclosure for a fluid flow control device, it is not intended that such references be construed as limitations upon the scope of this invention except as set forth in the following claims.

What I claim is:

1. A protective enclosure for covering an exterior, aboveground backflow prevention device comprising a plurality of valves wherein a first valve maintenance cover is oriented for removal from the top thereof along a substantially vertical axis and a second valve maintenance cover is oriented for removal from the side thereof along a substantially horizontal axis, said protective enclosure comprising:

a front wall panel, a back wall panel, selectively removable first and second side wall panels disposed between the front and back wall panels and a roof panel that substantially covers said wall panels, said roof panel being hingedly secured to pivot about a roof pivot axis that is adjacent to and substantially parallel with said first side wall panel, said second valve maintenance cover being disposed adjacent said first side wall panel with said horizontal axis disposed substantially normal to said first side wall panel.

2. A protective enclosure as described by claim 1 wherein said first valve maintenance cover is disposed proximate of said second sidewall panel whereby pivoted displacement of said roof panel about said roof pivot axis provides clearance for removal of said first valve maintenance cover.

3. A protective enclosure as described by claim 1 whereby removal of said first sidewall panel from between said front and back wall panels provides clearance for removal of said second valve maintenance cover.

4. A protective enclosure as described by claim 2 whereby removal of said first side wall panel from between said front and back wall panels provides clearance for removal of said second valve maintenance cover.

5. A protective enclosure as described by claim 1 wherein one of said side wall panels comprises reclosable means for releasing fluid from within said enclosure.

6. A protective enclosure for an exterior, above-ground backflow preventive valve assembly, the valve assembly including a first valve body having a first maintenance cover that is removable from the first valve body in a substantially vertical direction and a second valve body having a second maintenance cover that is removable from the second valve body in a substantially horizontal direction, said enclosure comprising:

first and second side walls removably positioned between front and back walls, said walls being substantially covered by a roof panel, said roof panel being hinged to pivot about a substantially horizontal axis disposed adjacent to and substantially parallel with said second sidewall, said first side wall being disposed adjacent to said first valve body and said second side wall being disposed adjacent to said second valve body, whereby said roof panel may be pivoted about said horizontal axis for clearance to remove said first maintenance cover.

7. A protective enclosure for a backflow preventive valve assembly as described by claim 6 whereby said second side wall assembly must be removed from between said front and back walls for clearance to remove said first maintenance cover.

8. A protective enclosure for a backflow preventive valve assembly as described by claim 6 wherein roof panel hinges are secured to said front and back walls.

9. A protective enclosure for a backflow preventive valve assembly as described by claim 6 wherein said first and second side walls are removable from between said front and back walls when said roof panel is pivoted for clearance to remove said first maintenance cover.

10. A protective enclosure for a backflow preventive valve assembly as described by claim 6 wherein one of said side walls comprises reclosable means for releasing water from within said enclosure.

11. The combination of an exterior, above-ground backflow prevention device and an enclosure around said device, said backflow prevention device comprising first and second valve bodies, each of said valve bodies having respective valve maintenance covers, said first valve body being oriented for removal of a first valve maintenance cover upwardly along a substantially vertical axis, said second valve body being oriented for removal of a second valve maintenance cover laterally along a substantially horizontal axis, said enclosure comprising first and second side walls removably positioned between front and back walls and a removable roof panel overlying said walls, whereby removal of said second side wall from between said front and back walls provides clearance for removal of said second valve maintenance cover.

12. The combination as described by claim 11 wherein said removable roof panel is pivotally secured for rotation about a substantially horizontal axis disposed proximately of and substantially parallel with said second side wall.

13. The combination as described by claim 12 wherein rotation of said roof panel about said axis provides clearance for removal of said first valve maintenance cover.

14. The combination as described by claim 11 wherein said backflow prevention device further comprises third and fourth valve bodies, said third and fourth valve bodies having third and fourth respective rotational axes for respective third and fourth valve closure operating means, said third and fourth valve bodies being oriented to align said third and fourth rotational axes substantially parallel and horizontal.

15. The combination as described by claim 14 wherein removal of said first side wall from between said front and back walls provides substantially unrestricted access to said third valve closure operating means.

16. The combination as described by claim 14 wherein removal of said second side wall from between said front and back walls provides substantially unrestricted access to said fourth valve closure means.

17. The combination as described by claim 11 wherein one of said side walls comprises reclosable means for releasing fluid from within said enclosure.

* * * * *

UNITED STATES PATENT AND TRADEMARK OFFICE

CERTIFICATE OF CORRECTION

PATENT NO. : 6,173,733 B1
DATED : January 16, 2001
INVENTOR(S) : Charles Gerald Pruitt and Earl Guy Greco It is certified that error appears in the above-identified patent and that said Letters Patent is hereby corrected as shown below:

Column 4,
Line 35, after "lines" "A-A" should be -- 4-4 --

Drawings,
Fig. 3, change heater element 80 from dashed to solid lines. (as shown on attached page)
Fig. 3, relabel sectional line "A-A" as -- 4-4 --. (as shown on attached page)
Fig. 7, change heater element 80 from dashed to solid lines. (as shown on attached page)

Signed and Sealed this

Fifth Day of February, 2002

*Attest:*

*Attesting Officer*

JAMES E. ROGAN
*Director of the United States Patent and Trademark Office*